United States Patent [19]

Mischler

[11] Patent Number: 4,986,180

[45] Date of Patent: Jan. 22, 1991

[54] DEVICE FOR CONTROLLING THE OPENING OF AN INK FOUNTAIN OF A PRINTING MACHINE

[75] Inventor: Gilbert Mischler, Avenches, Switzerland

[73] Assignee: Bobst SA, Switzerland

[21] Appl. No.: 359,167

[22] Filed: May 31, 1989

[30] Foreign Application Priority Data

May 31, 1988 [CH] Switzerland ..... 02069/88

[51] Int. Cl.[5] ..... B41F 31/04; B41F 31/06

[52] U.S. Cl. ..... 101/365

[58] Field of Search ..... 101/365, 350, 207–210, 101/169, 157, 349, 363

[56] References Cited

U.S. PATENT DOCUMENTS 3,730,090 5/1973 Lamberg ..... 101/365

4,328,748 5/1982 Schramm ..... 103/365

4,803,923 2/1989 Kenichi ..... 101/365

*Primary Examiner*—J. Reed Fisher

*Attorney, Agent, or Firm*—Hill, Van Santen, Steadman & Simpson

[57] ABSTRACT

A device for closing the opening of a gap in an ink fountain between a doctor blade and a surface of the ink roller characterized by the doctor blade being formed by a row of lamellae arranged on a common plane and for movement orthogonically relative to the roller. The device for controlling including a module for each lamella mounted by a module frame in the ink fountain. The module contains a linear positioning device having an axle which is connected to the lamella to shift the lamella in the plane, a detector to determine the position of the axle and a control unit controlling the drive device to shift the lamella to the desired position in response to the detected position.

6 Claims, 5 Drawing Sheets

DEVICE FOR CONTROLLING THE OPENING OF AN INK FOUNTAIN OF A PRINTING MACHINE

BACKGROUND OF THE INVENTION

The present invention is directed to a device for controlling the opening of an ink fountain of a printing machine which device enables the dosing of the amount of ink to be supplied to the inking roller before the ink in transferred by the distributing rollers to the printing plate.

The quality of a printing run on offset printing machines depends on a number of parameters such as on the chemical characteristics and surface texture of the paper, the wettability of the plate of the plate cylinder, the printing speed as well as the quality and quantity of the printing ink delivered by the available inking system of the machine. Expressed with more precision, this means that the amount of ink carried onto the printing plate is to correspond to a minimum quantity required for insuring proper printing and as far as possible this minimum quantity is to be compensated laterally and longitudinally according to irregularities of the ink consumption which will correspond to the requirements of a given image.

The ink fountains of an offset printing machine consist in many cases of a very broad basin which has a sloping bottom wall that coacts with a rotating inking roller to form the entire basin. An opening of the ink fountain through which ink is supplied consists in a bottom slot or gap between the edge of the bottom wall and the surface of the inking roller and preferably a doctor blade forms this edge of the bottom wall. According to an early constructional concept, the doctor blade is applied in a fixed tangential position on the inking roller. Its outer longitudinal edge is then moved more or less towards the surface of the inking roller by the action of a number of equal distance setting screws. The major draw-back of this device is the impossibility of a fine adjustment at a given point without influencing the adjacent points. In practical application this design prevents accurate dosing of the quantity of ink to be supplied for printing a page which has strong vertical contrast.

With a view before limiting the interference appearing between the adjacent adjustment means, a suggestion has been made to subdivide the doctor blade into a row of lamellae or small plates which are arranged side by side in a plane and each of these plates have a separate mechanical or electro-mechanical means to shift the edge of the plate toward and away from the surface of the roller. A first example of such an arrangement is illustrated in U.S. Pat. No. 4,328,748 whose disclosure is incorporated by reference thereto. In this patent, every plate is normally pushed against the inking roller by a spring from which position it is pulled back by an electro-magnetic relay over a predetermined distance which is controlled by two stops. Considering only the possible "open" and "closed" positions of these lamellae, the quantity of ink flowing through the gap between the edge of each lamella and the roller is then determined by means of a time interval during which the various lamella remain in a retracted or open position. This device provides a "package-wise" inking delivery.

According to a second constructional concept, every lamella or plate acts as a short arm of a lever fitted in a rotary way along an axle close to the inking roll whereby the long vertical lever arm, that is turned downward, is shifted laterally by an intermediate piece within which a horizontal drive worm is actuated by an electric motor. In this assembly, a spring holds the long lever arm permanently against the intermediate piece. In this way, a double reduction effect is achieved first by means of a drive worm shifting the intermediate piece and secondly due to the dimensions of the respective lever arms and this enables the conversion of several revolutions of the electrical motor into a small displacement of the front surface or edge of each lamella. However, the relatively slow speed of the electric motor as well as the demultiplication do not allow a modification of the dosing action sufficiently quickly in cases with strong printing contrasts on pages with columns and line print. Moreover, it is impossible to avoid any mechanical precision inherent in the connection of the drive worm and the intermediate piece.

According to another constructional concept which is developed by the applicant, a setting piece is shifted in-line over infinitesimal distances owing to a screw with two different threads of which one is screwed into a frame and the other into an intermediate piece. This screw is driven by an synchronous AC motor through a reduction gear. Considering the minor or weak movements at the end of the reduction gearing, it is only possible to hold this device in position if a movement measurement is taken from the second demultiplied outlet motion of the reduction gear so that the measurement does not take into account possible mechanical clearances or play within the reduction gear or in the connection between the outlet shaft and the differential threaded screw at the level of the threads and the corresponding tapped orifices or bores. Moreover, there is no possibility to modify the speed of the synchronous motor if the motion of the setting piece is to be accelerated. Finally and especially this device represents a complex design involving considerable manufacturing expenses and maintenance costs.

SUMMARY OF THE INVENTION

The object of the present invention is to put forth a solution allowing a resolution of the above described problems by means of a quick and accurate control means or device for the opening of a ink fountain within an offset printing machine which control device allows an accurate supply of ink to the inking roller of the plate inking system. This device is to involve a minimum of mechanical connections enabling a reduction not only of the contingencies due to functional clearances but also the manufacturing and maintenance costs. Moreover, the initial start-up of the device is to be facilitated by the application of a quick control system allowing opening to a reference value on the one hand and an easy setting of the openings with regard to the other elements on the other hand. This device should moreover allow a consideration of other parameters essential for reliable inkings such as the physical and chemical natures of both the ink and the paper.

These objects are attained in a device in the printing machine in which the ink fountain has a shape of a sloping bottom basin turned toward an inking roller acting as one side of the basin and the opening in the bottom of the basin is formed by a gap between a surface of the inking roller and a row of orthogonically movable lamellae mounted at the end of a bottom wall of the basin adjacent to surface of the roller in a common plane with the view to making up a doctor blade parallel to the roller. The improvement is that each lamella is shifted by a linear position actuator having an axle which is aligned with a shifting axis of the lamella and engages a rear edge of the lamella, said positioning actuator being connected by an intermediate piece within a housing permanently assembled with the ink fountain by means of a frame and the housing is possibly contained within a modular unit, means for detecting a reference position and an additional every movement of the axle with regard to the actuator housing, and control means which depending on the electrical control signals applied to them will switch the actuator on and off in order to call forth a specific forward or backward lamella movement with regard to the inking roller and to compare the movement with the means for detecting to determine whether the axle movement has been carried out and whether additional movement is necessary and which control means switches off the actuator when no additional corrective movement is necessary.

The device is enhanced by an electronic data processor enabling the operator to determine through a keyboard and a screen the desired command or control signals while taking into account the various parameters such as location of the condensed image on the page, the characteristics of the ink in paper, the modifications of the positions of one or several lamellae specifically in a given period of time and to translate these modifications both for direction and unit rate for shifting of the axle of each corresponding actuator. These electrical control signals are transmitted to the electronic preamplifier and interface means which means organizes the addressing of the electrical control signals to all the control means of each of the individual actuators concerned along a bus line connecting all control means associated with one fountain to the electronic preamplifier and interface means.

Preferably the plane determined by the lamellae arranged side by side and making to deform the doctor blade crosses the inking roller on a secant plane. The secant plane could possibly cut the axis of rotation for the inking roller.

In another preferred characteristic, the position of the actuator support frame with regard to the ink fountain basin is adjusted by a screw with two different threaded portions. One portion is screwed into a tapped orifice or bore of the frame and the other portion is screwed into a tapped orifice or bore of the basin so that the frame can be adjusted relative to the basin before it is locked in a given position by mechanical means.

Other features and advantages of the present invention will be readily apparent from the following description of the preferred embodiments, the drawings and claims.

DESCRIPTION OF THE PREFERRED EMBODIMENTS

Figure 1:
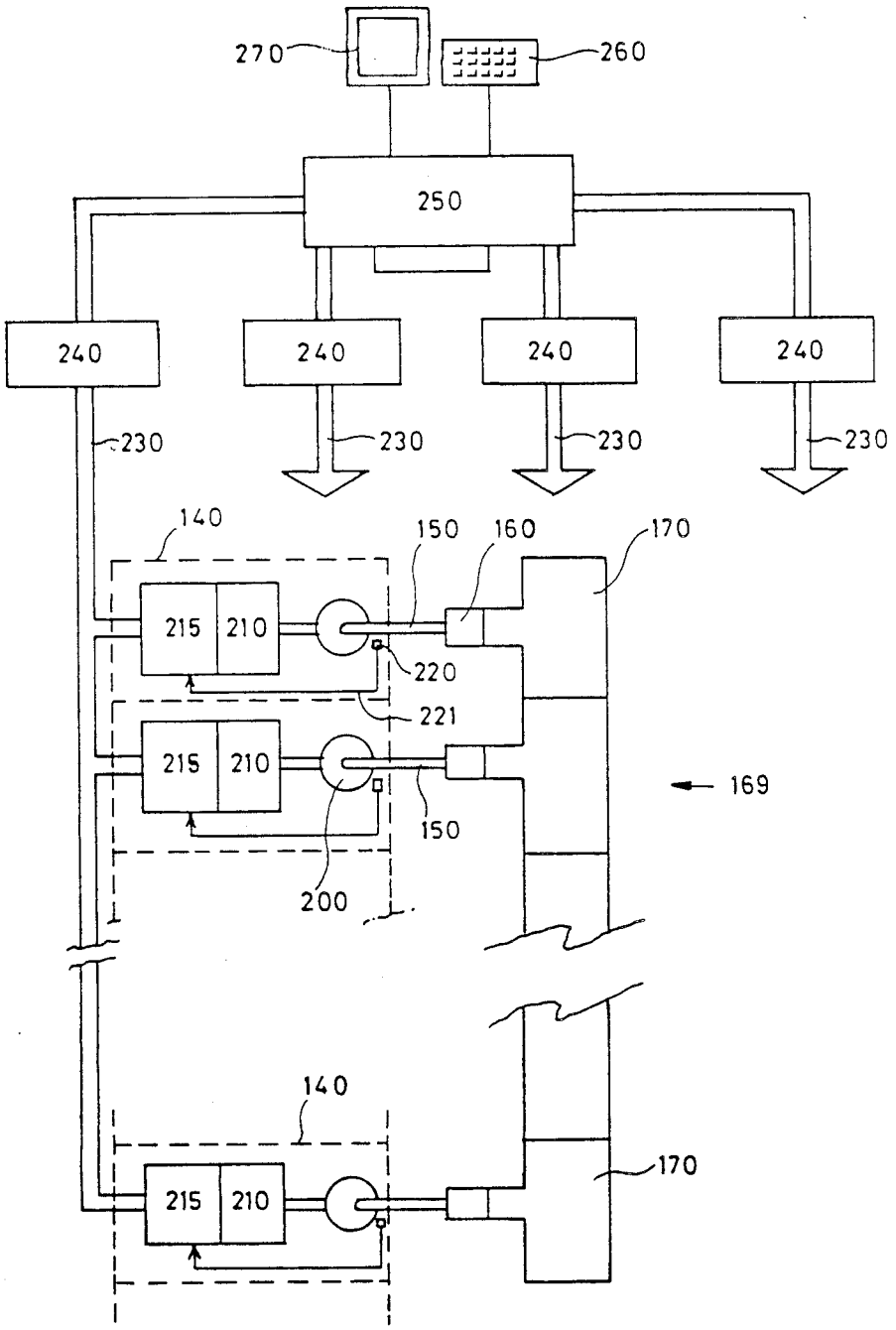
FIG. 1 is a diagram of the control system for the device of the present invention.
Figure 2:
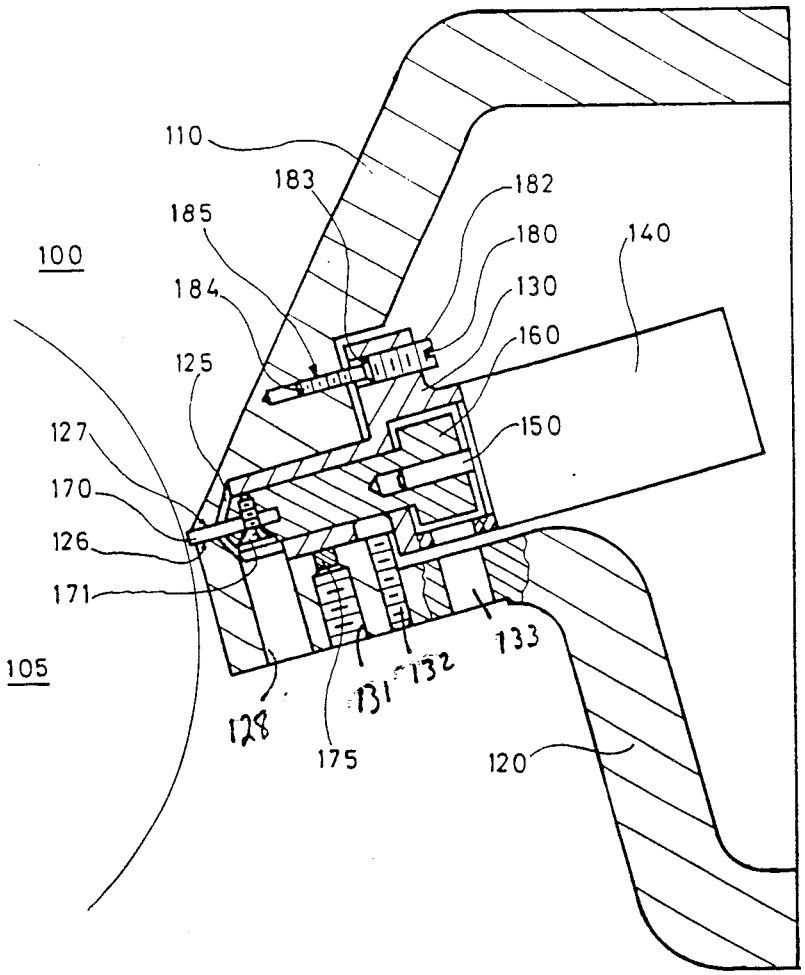
FIG. 2 is transverse cross-sectional view of a first embodiment of the improved ink fountain of the present invention.

The principles of the present invention are particularly useful when incorporated in a ink fountain 100 of FIG. 2. The ink fountain 100 of FIG. 2 has a doctor blade 169 (FIG. 1) which is made up of a row of lamellae 170 which are arranged side by side on a common plane. The rear end of each of the lamellae 170 is connected to a separate axle or rod 150 of a corresponding drive module 140. The drive module is able to impart to each lamella an advance or retraction motion with regard to a surface of an ink roller 105 (FIG. 2) and the module 140 is thus held in the plane of the doctor blade in a manner to be described hereinafter.

Every drive module 140 includes a control means 215 which may be a printed circuit board containing a processor and which receives electrical control signals from a bus line 230. The control means 215 output is connected to an amplifier 210 which transforms the control impulses provided by the control means 215 into electrical power to switch on a drive unit 200 which will move or shift the axle 150. A detector 220 is connected to the control means 215 through a line 221 and will transmit each motion carried out by the axle 150. The detector 220 thus determines when the axle is in a reference position and also determine where it is relative to the reference position.

All modules 140, which drive the lamellae belonging to the row which makes up the doctor blade 169, are connected through the bus lines 230 to a pre-amplification and interface unit 240 which may also be a printed circuit board. The bus lines 230 consists actually of a limited number, for example, five parallel extending lines and each of the control units or means 215 are parallelly connected to every one of these wires. Each of the control units or printed circuit boards 240 is in itself connected to electronic data processing means 250 which may be a microcomputer or microprocessor in which an operator is able to communicate and operate by use of a keyboard 260 and a screen 270. In the case of multicolor printing presses which have more than one plate cylinder and ink fountain, the electronic data processor means 250 is connected to the same number of preamplifiers and interface units 240 as there are ink fountains and each unit 240 controls the number of drive modules corresponding to the series of lamellae forming the doctor blade of the respective ink fountain.

Figure 3:
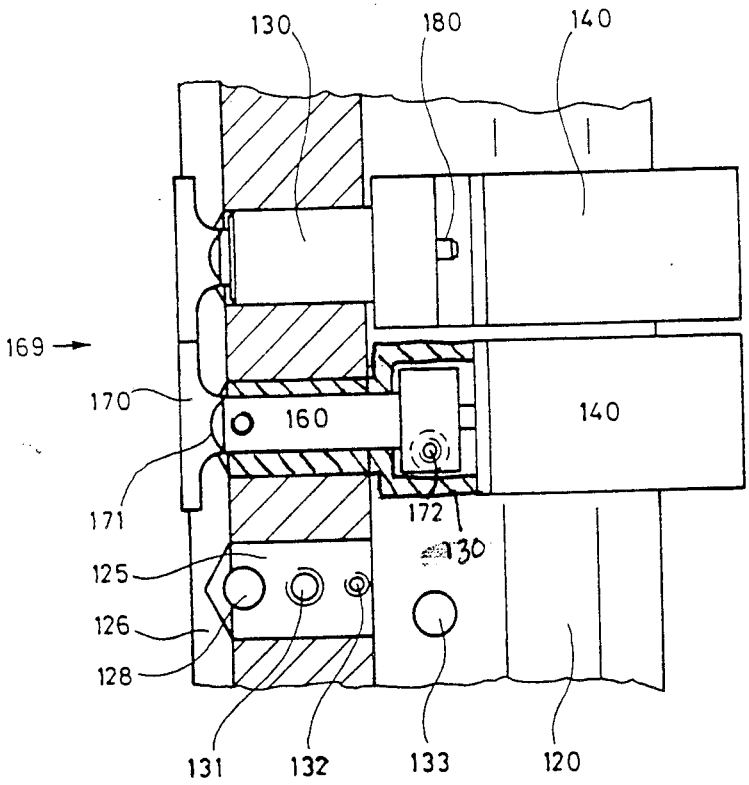
FIG. 3 is a partial top plan view of the device of FIG. 2 with portions broken away for purposes of illustration.

The first embodiment of the doctor blade and its equipment is illustrated in FIG. 2 and 3. As illustrated, the ink fountain 100 on the right hand side has a sloping bottom wall 110 which coaxes with the surface of an ink roller 105 to form a basin for receiving the ink. A row of lamellae 170 forms a doctor blade 169 that extends parallel to the surface of the inking roller 105 and limits the aperture or slot that extends between the surface of the ink roller 105 and the outer edge of the sloping bottom wall 110. This aperture or slot is used for allowing the passage of ink, which is drug by the roller 105 as the roller rotates in a clockwise direction. The ink after it passes through the aperture is transferred by the roller 105 in a conventional manner either directly on to the printing cylinder or to an intermediate roller which in turn transfers it to the printing cylinder.

In order to reduce the draw backs of static and dynamic forces, which appear between the ink, the basin walls and the ink roller, the lamellae 170 had been oriented in such a way that the plane formed by the lamellae cuts through the axis of rotation of the inking roller 105.

The basin includes a chasis or base 120 which coaxes with the sloping bottom wall 110 and is formed by a single piece which is constructed in such a way that it provides a series of equal distance cylindrical seats or bores 125 which have a central axis which extends parallel to one another and cut orthogonically the axis of the inking roller 105. The base 120 is provided with three holes or bores for each of the seats that are spaced along the axis of the seat with the first bore or axis 128 being adjacent to the edge of the bottom wall 110 and the remaining two bores being tapped bores 131 and 132. Each of the bores or seats 125 open onto the inking roll side with two parallel planar lips including a bottom lip 126 and an upper lip 127 which are machined along the edge of the chasis 120 and the bottom wall 110 respectively. The distance between the lips corresponds to the thickness of the lamellae 170. The lips had been designed to guide the lamellae 170 when the lamellae move back and forth with regard to the surface of the roller 105.

Every one of the bores or seats 125 contains an inserted cylindrical front part of a frame 130 which has a rear part illustrated as being formed as an upwardly extending block or parallelepiped. On an axis of the front cylindrical part, the rear part contains a circular chamber with an inner diameter that exceeds the inner diameter of the front part. The rear part also has a first tapped bore 183 in its upper section which is aligned with a second tap bore 185 which is provided in the bottom wall 110 for each of the seats or bores 125. The bore 185 is substantially parallel in position with regard to the axis of the seat 125 and to the extension of the first bore 183. A positioning screw 180, which has two inverse threads with different pitches, one corresponding to the threads of the bore 183 and the other thread being smaller and corresponding to the threads of the bore 185 is simultaneously screwed into the two orifices or bores. On account of the different pitches, every turn of the screw 180 causes a shift of the frame through a very small distance with regard to the chasis 120 and to the bottom wall 110 to facilitate an accurate setting of the position of the frame 130 therein. A set screw or a lock screw 175 is threaded into the bore 131 and provides an inner lock of the position of the frame 130 once the frame has been placed in the desired axial position within the bore 125.

The drive module 140 has a form of a centrifugal block which is screwed onto a rear side of the frame 130 in such a way that the axle 150 of the inner drive module 200 lies on the axis of the seat 125 and an ax±s of the front part of the frame 130. An intermediate cylindrical piece 160 is secured to the axle 150 due to tightening of screws 172 (see FIG. 3) which is offset from the axis of the seat 125 and can be reached through an aperture 133 in the chasis 120 and is offset from the bores such as 131 and 132 (see FIG. 3). The intermediate piece 160 is received in the inner chamber of the frame 130 and on a forward end is connected to the lamellae 170 by a threaded screw such as 171 which as illustrated in FIG. 2 is accessible through the orifice or bore 128.

As may be gathered, there is a direct link between the lamella or plate 170 and the axle 150. The lamella or plate 170 is thus moved forward or backward with the same precision as the motion of the axle or rod 150.

Figure 4:
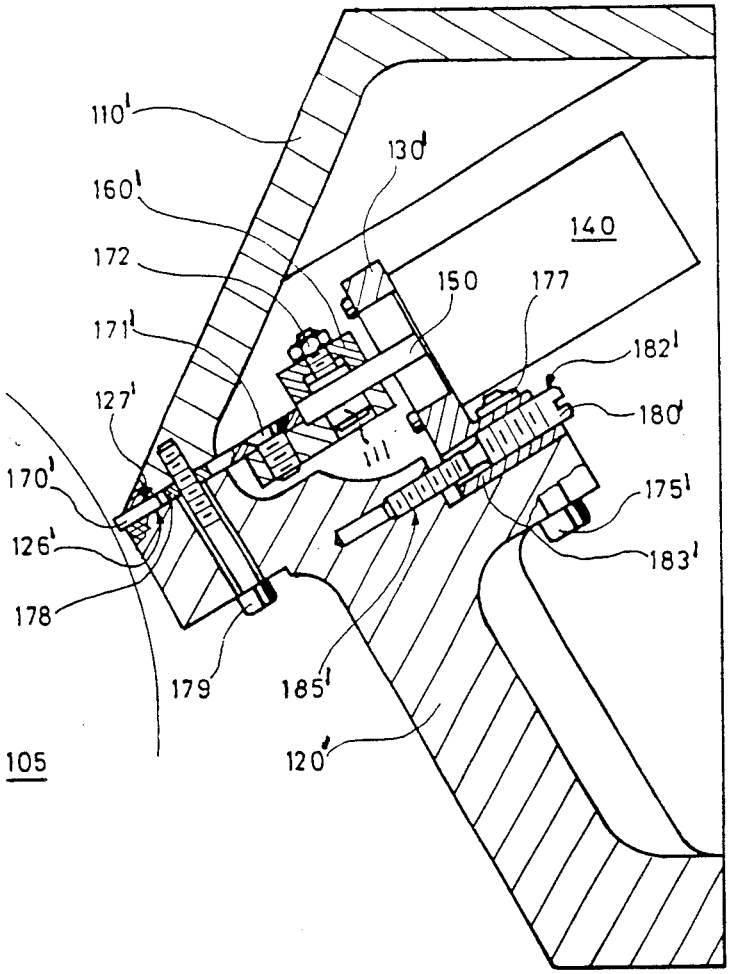
FIG. 4 is a transverse cross-sectional view of a second embodiment of the device of the present invention.
Figure 5:
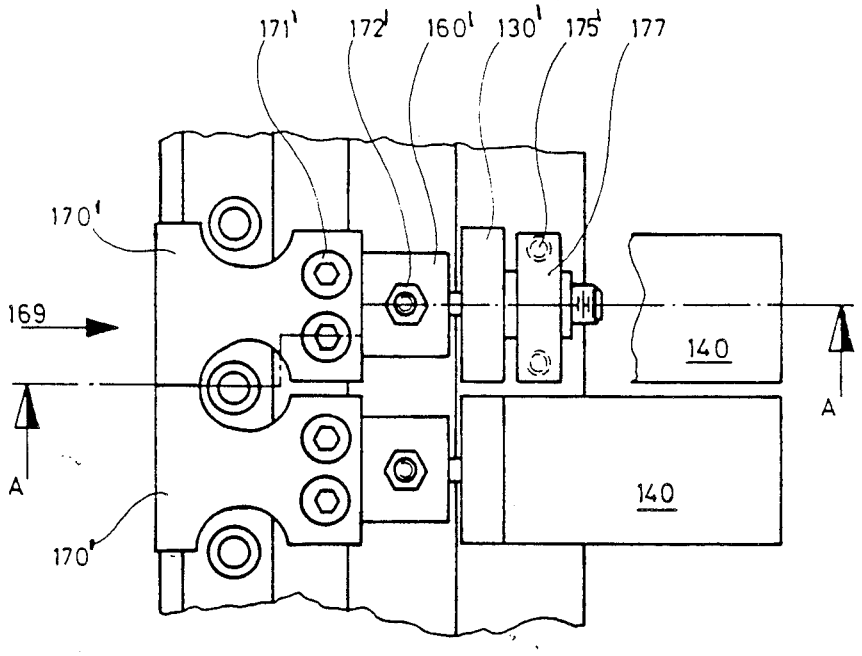
FIG. 5 is a top plan view of the device of FIG. 4 with portions removed for purposes of illustration.

A second embodiment of the connection of the drive module 140 to a lamellae 170 is illustrated in FIGS. 4 and 5. In this embodiment the same element numbers with a prime used to describe parts which are similar to the parts of the embodiment of FIGS. 2 and 3. The ink fountain 100 is illustrated in FIGS. 4 and 5 consists of a sloping bottom wall 110' which has an edge space from surface of the inking roller 105. A lower chasis or base 120' is connected to the bottom wall 110' by a series of threaded fasteners 179. To insure a proper spacing between a surface 127' of the lower wall 110' and a surface 126' of the chasis 120', a shim 178 is provided as illustrated in FIG. 4. The shim 178 has a thickness which is slightly bigger than the thickness of the lamellae 170 which are arranged to slide in a plane defined by the surfaces 126' and 127'. The lamellae 170' are arranged to extend side by side so as to form the doctor blade 169.

Every one of the lamellae 170' is actuated from behind through an intermediate piece 160' by a drive device 200 which is inside a drive module 140 which in turn is secured on a frame 130'. The lamellae 170' is connected to the intermediate piece 160' by means of a fastener 171'. The piece 160' is permanently connected together with the axle 150 of the module 140 by means of an inner tightening piece 111 and a tightening nut 172. As in the previous mentioned embodiment, the position of the frame 130' with regard to the lower chasis 120' is adjusted by means of a double threaded screw 180' operating within the tapped bores 183' of the frame and a second threaded bore 185' in the chasis 120' and aligned with the bore 183'. Once the position of the frame 130' is attained relative to the chasis 120', it can be locked in the fixed position by tightening two bolts 175' which are threaded into a small bar 177.

The previously described device operates in the following way. When the apparatus is put into operation after the first time or after it has undergone regular maintenance, the operator controls the apparatus by actuating the keyboard 260 in order to set all lamellae 170 or 170' in the reference position of the drive device 200. This command, which is transformed into electrical signals, is transferred through the interface 240 to the control means 215 of every module 140. The drive device 200 will then actuate the axle 150 until the detector 220 is able to spot the reference position. At this stage, the operator is able to modify the position of every module 140 and of the frame 130 or 130' with regard to the chasis 120 and 120' by actuating the positioning screws 180 or 180' in such a way that all the lamellae 170 will be aligned and hence cause the same size gap or slot adjacent the inking roller 105. Once the modules 140 are positioned, they are locked by means of the set-screw such as 175 or by the threaded fasteners 175'. The alignment of the lamellae 170 can be achieved either visually or by means of successive tests destined to insure the ultimate delivery of the perfect regular film along the doctor blade 169.

After this preliminary setting, the operator is able to gauge the doctor blade as required by lateral and longitudinal contrast on the page to be printed.

According to the first operational concept especially with pages that have only column-shaped contrast, the operator is able to select directly the position of every lamellae which position are transferred as a series of electrical commands to the interface unit 240 which in turn transmits these commands from the interface 240 to every control means 215 in a shape of a pulse command for shifting the direction and several pulses resulting in a number of required basic movements to be applied by the drive device 200 to the axle 150. Every one of the control units 215 will take the signal addressed to it and determine the direction and the number of unit wise movements that are to be transformed into electrical pulses used for directly switching of the drive unit or device 200. When this movement occurs, the detector will check to determine whether the movement actually has taken place and should the latter not be the case, the control unit 215 will take appropriate corrective action. Thus, the actual position of each of the rods or axles 150 is determined by the detector 220 and this position is compared in the control unit 215 to the desired position and appropriate error signals are generated to move it to the desired position.

In a second and perhaps more complex operational concept, the electronic data processing means 250 contains a calculation program which is either lodged in a live or permanent memory section and from a description of the page to be printed determined the sequence of the distances for every lamellae from the surface of the inking roller on the basis of the angular position of the inking roller or read by a sensor located on the shaft of the roller. The calculation process of this program also include parameters initially keyed in for the ink viscosity, the paper absorbency, and coating of the rollers designed for the inking system.

Although various minor modifications may be suggested by those versed in the art, it should be understood that I wish to embody within the scope of the patent granted hereon all such modifications which reasonable and properly come within the scope of my contribution to the art.

I claim:

1. In a device for controlling the opening of an ink fountain of a printing machine, said ink fountain having the shape of a basin with a sloping bottom oriented towards an inking roller, said basin having a number of lamellae orthogonically movable towards a surface of the roller and arranged side by side on a common plane at a bottom wall of the basin to form a doctor blade, which coacts with the surface of the roller to define a gap for passage of the ink, the improvements comprising each lamella having a module, each module having a frame and a housing with the housing being mounted by the frame on a portion of the ink fountain, each module having a linear positioning means with an axle aligned with the lamella and connected to a rear edge of the lamella by an intermediate piece, detector means being disposed in each module for detecting a reference position of the axle and the movement of the axle with regard to the housing of the module, control means disposed in each of the modules for receiving electrical command signals and controlling linear positioning means to shift the lamella forward and backward with regard to the surface of the inking roller to a desire position, said control means receiving inputs of the detector means to compare the actual position to the desired position and creating an appropriate error signal to obtain the desired position for the lamella.

2. In a device according to claim 1, which includes an electronic processing means having a keyboard for receiving inputs and a screen to displaying the signals, said electronic processing means providing electrical command signals to an electronic pre-amplification and interface means, said electronic pre-amplification and interface means providing electrical control signals to the control means of the module for each lamella.

3. In a device according to claim 1, wherein the common plane of the lamellae crosses the inking roller on a secant plane.

4. In a device according to claim 1, wherein each frame includes means for adjusting the position of the frame and module along the axis of the axle, said means for adjusting including a position screw with two different threads, one being threaded into a tapped bore in the frame and the other into a tapped bore provided in the basin for said ink fountain, said adjustment means including means to mechanically lock the frame in an adjusted position.

5. In a device according to claim 4, wherein each lamella is guided to move in the common plane by an upper lip formed in an upper wall portion of the fountain and a lower lip formed on a base of said fountain.

6. In a device according to claim 1, wherein an upper wall portion of the fountain has an upper lip, said fountain having a base with a lower lip spaced from the upper lip to form a slot receiving the lamellae to guide the lamellae for movement along said common plane.

* * * * *